US009180655B2

(12) United States Patent
Peleg et al.

(10) Patent No.: US 9,180,655 B2
(45) Date of Patent: Nov. 10, 2015

(54) CONVERTIBLE BUFFERS FOR WEB PRESSES

(75) Inventors: Eyal Peleg, Zoran (IL); Itzik Kent, Ness Ziona (IL); Benji Ruhm, Tel-Aviv (IL); Erez Elias, Gedera (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 13 days.

(21) Appl. No.: 14/003,422

(22) PCT Filed: Mar. 11, 2011

(86) PCT No.: PCT/EP2011/053720
§ 371 (c)(1),
(2), (4) Date: Sep. 5, 2013

(87) PCT Pub. No.: WO2012/123012
PCT Pub. Date: Sep. 20, 2012

(65) Prior Publication Data
US 2014/0158006 A1 Jun. 12, 2014

(51) Int. Cl.
*B41F 13/54* (2006.01)
*B41F 13/012* (2006.01)
*B41F 13/00* (2006.01)
*B41F 13/02* (2006.01)

(52) U.S. Cl.
CPC ..... *B41F 13/012* (2013.01); *B41F 13/0024* (2013.01); *B41F 13/025* (2013.01)

(58) Field of Classification Search
CPC ..... B41F 13/012; B41F 13/0024
USPC ..... 101/228
See application file for complete search history.

(56) References Cited

U.S. PATENT DOCUMENTS

| | | | | |
|---|---|---|---|---|
| 4,325,301 | A * | 4/1982 | Grosshauser | 101/217 |
| 4,393,772 | A * | 7/1983 | Burger | 101/217 |
| 4,401,028 | A * | 8/1983 | Kobler et al. | 101/178 |
| 5,003,889 | A * | 4/1991 | Glunz et al. | 101/228 |
| 5,228,672 | A * | 7/1993 | Pane | 83/78 |
| 5,860,053 | A | 1/1999 | Stemmle | |
| 6,539,857 | B1 * | 4/2003 | Weschenfelder | 101/137 |
| 6,763,220 | B2 | 7/2004 | Nakazawa | |
| 2006/0150838 | A1 * | 7/2006 | Hollings et al. | 101/180 |
| 2008/0257181 | A1 * | 10/2008 | Gertsch et al. | 101/220 |
| 2011/0162544 | A1 * | 7/2011 | Ruhmke et al. | 101/216 |

FOREIGN PATENT DOCUMENTS

| | | | |
|---|---|---|---|
| EP | 0384385 | A2 | 8/1990 |
| EP | 0904935 | A2 | 3/1999 |
| GB | 2092523 | A | 8/1982 |
| JP | 2005060079 | A | 3/2005 |
| WO | WO-2009108204 | A1 | 9/2009 |

OTHER PUBLICATIONS

"Anderson Lithograph Adds New Mitsubishi Diamond 16 MAX-M Web Offset Press with Mini-Gap Design"; Mar. 6, 2006; http://www.peguide.com/news/2006/03-06/mitsubishi%2003-07-06.h.

* cited by examiner

*Primary Examiner* — Anthony Nguyen

(57) ABSTRACT

In one example, a web press includes a web press station and a convertible buffer near the web press station, the convertible buffer being configured to convert to a platform for accessing the web press station. A method for performing web press maintenance is also disclosed.

13 Claims, 7 Drawing Sheets

CONVERTIBLE BUFFERS FOR WEB PRESSES

BACKGROUND

A web press prints on a continuous roll of substrate. The web press includes a number of stations that perform operations such as unrolling the substrate, depositing primer, printing, drying, calibrating, and finishing. The stations may operate for short periods of time at different web speeds. To accommodate these temporary differences in web speeds, the stations may be separated by buffers. The buffers coordinate the different web speeds by adjusting variable length substrate paths within the buffers. The stations are also separated by maintenance platforms. The maintenance platforms provide room for the technicians to stand and access the adjacent stations.

The combination of the stations, buffers and maintenance platforms can result in a web press that has a large footprint. For example, the maintenance platforms can consume about 20%-30% of the footprint of the web press. Reducing the footprint of the web press allows the web press to be placed within a smaller work area and lowers overhead costs for the operator.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
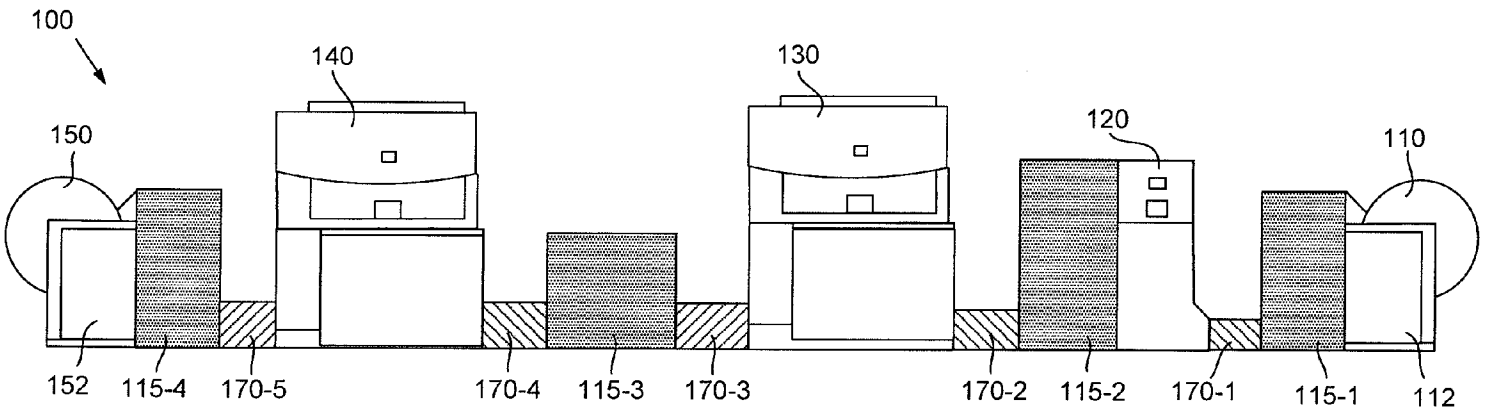
FIG. 1 is a diagram of an illustrative web press with buffers and maintenance platforms, according to one example of principles described herein.

A web press prints on a continuous roll of substrate. The substrate is continuously fed through a number of stations that perform operations such as unwinding the substrate, depositing primer, printing, drying, calibrating, and finishing. The stations may operate for short periods of time at different speeds. For example, as the web press is starting up, the unwinding station may need a short period of time to accelerate the substrate roll, while a printing station may be ready to operate at a nominal speed. To accommodate these temporary differences in web speeds, the stations may be separated by buffers. The buffers coordinate the different web speeds by adjusting variable length substrate paths. These variable length substrate paths are created passing the substrate over a number of idlers in a buffer. To lengthen the substrate path, the idlers are moved apart. To shorten the substrate path, the idlers are moved together. By changing the substrate path length within the buffer, the momentary velocity differences can be accommodated while still maintaining the desired tension in the substrate. As used in the specification and appended claims, the term "buffer" refers to a unit within a web press which alters the substrate path length to coordinate web speeds between adjacent machines during operation of the web press.

The stations are also separated by maintenance platforms. To perform maintenance tasks, it may be desirable to access the stations from all four sides. The maintenance platforms provide room for the technicians to stand and access adjacent stations. For example, to replace blanket roller in a digital offset printing station, the technician may wish to access the printing station from the direction the substrate enters the station. The maintenance platforms provide both room to access the printing station from the desired side and a place for the technician to stand while replacing the blanket roller.

The combination of the stations, buffers and maintenance platforms define the foot print of the web press. For example, the maintenance platforms consume about 20%-30% of the total footprint of the web press. Reducing the footprint of the web press would allow the web press to be placed within a smaller work area and lower overhead costs for the operator. Ideally, the reduction of the footprint of the press would not compromise access to the stations or the printing performance of the press.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

FIG. 1 is a side view of an illustrative web press (100). The substrate is fed into the web press from a large roll (110) on the right. An unwinder (112) supports the roll (110) and controls the unwinding process. The stations of the web press print the desired images and text on the substrate as it passes through them. The substrate continues through all the stations to a rewinder (152) on the left side of FIG. 1.

The various stations, buffers, and maintenance platforms in the web press will be discussed from right to left. After the unwinder (112), the substrate enters a first buffer (115-1). The first buffer (115-1) may be an integral part of the unwinder (112) or a separate unit. As discussed above, the first buffer (115-1) coordinates web speed between the unwinder (112) subsequent stations. To the left of the first buffer (115-1), a first maintenance platform (170) provides access to the right side of a primer station (120). The substrate passes out of the buffer (115-1), under the first maintenance platform (170-1) and into the primer station (120).

A second buffer (115-2) provides web speed coordination between the primer station (120) and a first printing station (130). The second buffer (115-2) may be an integral part of the primer station (120) or a separate unit. A second maintenance platform (170-2) is interposed between the second buffer (115-2) and the first printing station (130). The maintenance platform (170-2) provides access to the left side of the first printing station (130) and the right side of the second buffer (115-2).

A third maintenance platform (170-3) separates the first printing station (130) and a third buffer (115-3). The third buffer (115-3) coordinates web speeds between the first printing station (130) and the second printing station (140). A fourth maintenance platform (170-4) is interposed between the fourth printing station (140) and the second printing station (140). This maintenance platform (170-4) provides access to the right side of the second printing station (140). A fifth maintenance platform (170-5) provides access to the left side of the second printing station (140). In the web press (100), the printing stations (130, 140) work together to produce the desired printed images. In one implementation, the first printing station (130) may print on a first side of the substrate and a second printing station (140) may print on a second side of the substrate. If only one side of the substrate is to be printed during the current production run, one of the printing stations may simply pass the substrate without printing.

A fourth buffer (115-4) provides proper tensioning and coordination between the second printing station (140) and the rewinder (152). The rewinder (152) rolls the printed substrate onto a roll (150).

The example given above is only one illustrative web press arrangement. A number of other arrangements could be used. For example, the substrate may be cut, folded, and/or collated instead of being wound onto the roll (150). Additionally, some of the stations shown in FIG. 1 could be omitted or additional stations could be added. For example, the web press could include a dryer. The dryer ensures that inks are properly cured or dried before subsequent operations are performed.

As used in the specification and appended claims the term "web press station" or "station" is defined as any machine that actively performs operations during printing that can change the web speed and compensation for these changes in web speed are provided by a buffer. For example, an unwinder, primer, a print engine, dryer, and a rewinder are all web press stations that can influence the web speed.

Figure 2:
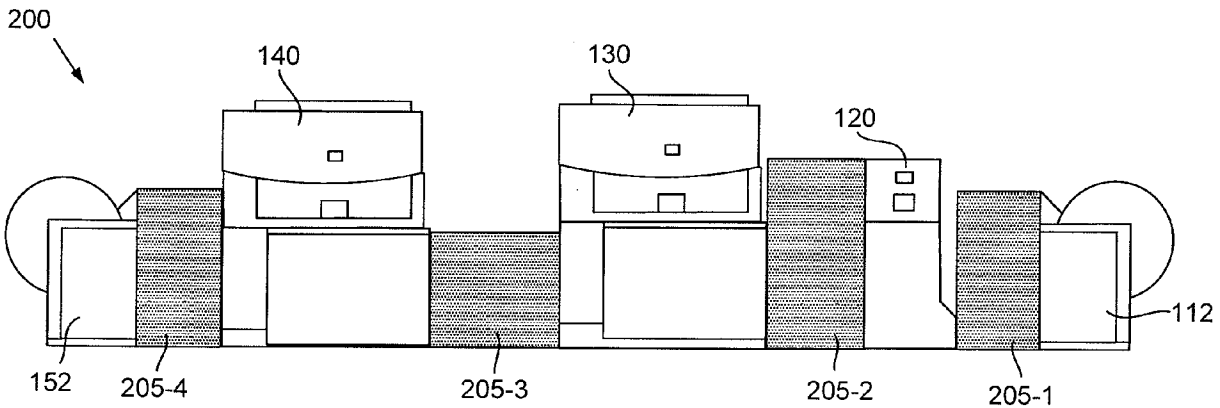
FIG. 2 is a diagram of an illustrative web press with convertible buffers, according to one example of principles described herein.

FIG. 2 is an illustrative example of a web press (200) that does not include maintenance platforms. As can be seen by comparing FIG. 1 and FIG. 2, the footprint of the web press (200) that does not include maintenance platforms is significantly smaller. In this example, convertible buffers (205) are interposed between each of the stations (112, 120, 130, 140, and 152). The convertible buffers (205) convert between an operating configuration and a reduced volume maintenance configuration. FIG. 2 shows the web press (200) with the convertible buffers (205) in the operating configuration. As used in the specification and appended claims, the term "convertible buffer" refers to a buffer which is convertible between an operating configuration in which the buffer adjusts a web path length and a non-operating configuration in which a standing platform is deployed. The use of the term "deploy," "deployed," or "deploying" with reference to a standing platform refers to presenting, exposing, or forming a standing surface.

Figure 3:
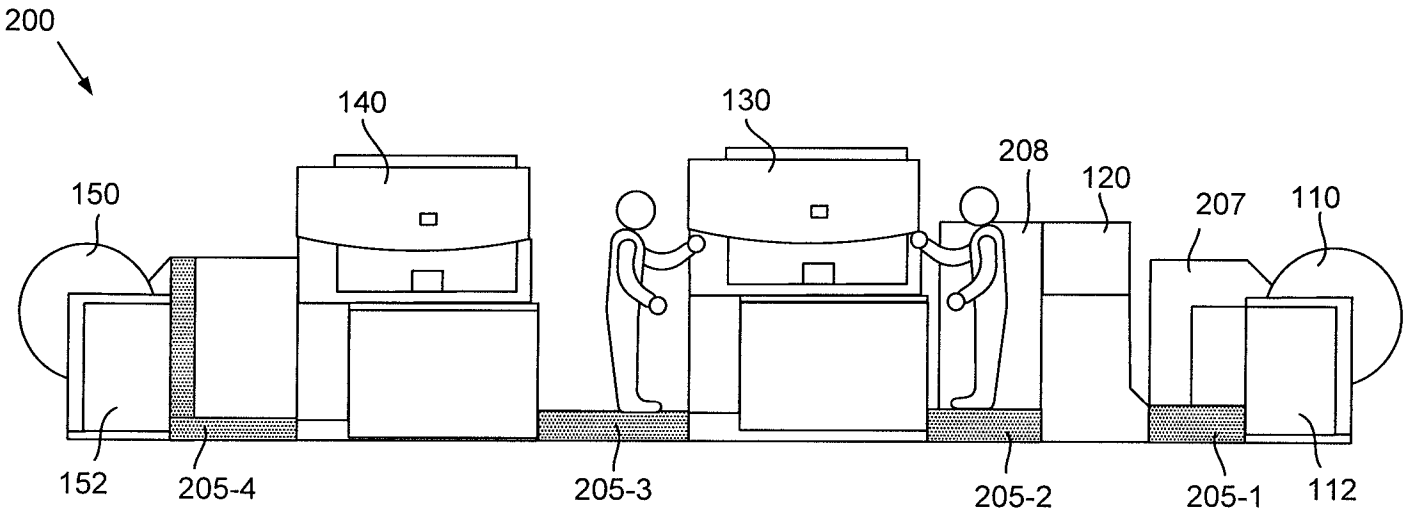
FIG. 3 is a diagram of an illustrative web press with the convertible buffers lowered to provide access for technicians to perform maintenance tasks, according to one example of principles described herein.

FIG. 3 shows the same reduced footprint web press (200) with the convertible buffers (205) in a reduced volume maintenance configuration. In this configuration, the convertible buffers (205) are converted to lower profile platforms. This simultaneously provides access to the sides of the various stations and provides standing platforms for technicians. In FIG. 3, two technicians are working on the first printing station (130), with the technician on the right standing on a convertible buffer (205-2) between the priming station (120) and the first printing station (130). A second technician is standing on a convertible buffer (205-3) between the first print station (130) and the second print station (140). Because the height of the buffers has been significantly reduced, the technicians have clear access to both sides of the first printing station (130).

The convertible buffers (205) may have a variety of configurations. The first two buffers (205-1, 205-2) lower vertically to provide access to the adjoining stations (112, 120, and 130). However, back plates (207, 208) that support the buffers (205-1, 205-2) remain in place and may prevent the technicians crossing from one side of the web press to the other side of the web press over the buffer. This configuration is described in greater detail in FIGS. 5A-5C. The central convertible buffer (205-3) is configured to be lowered and create a pathway from one side of the web platform to the opposite side. This configuration is described in greater detail in FIGS. 7A-7B. The left most convertible buffer (205-4) folds horizontally rather than vertically. This configuration is described in greater detail in FIGS. 6A-6C.

Figures 4A, 4B:
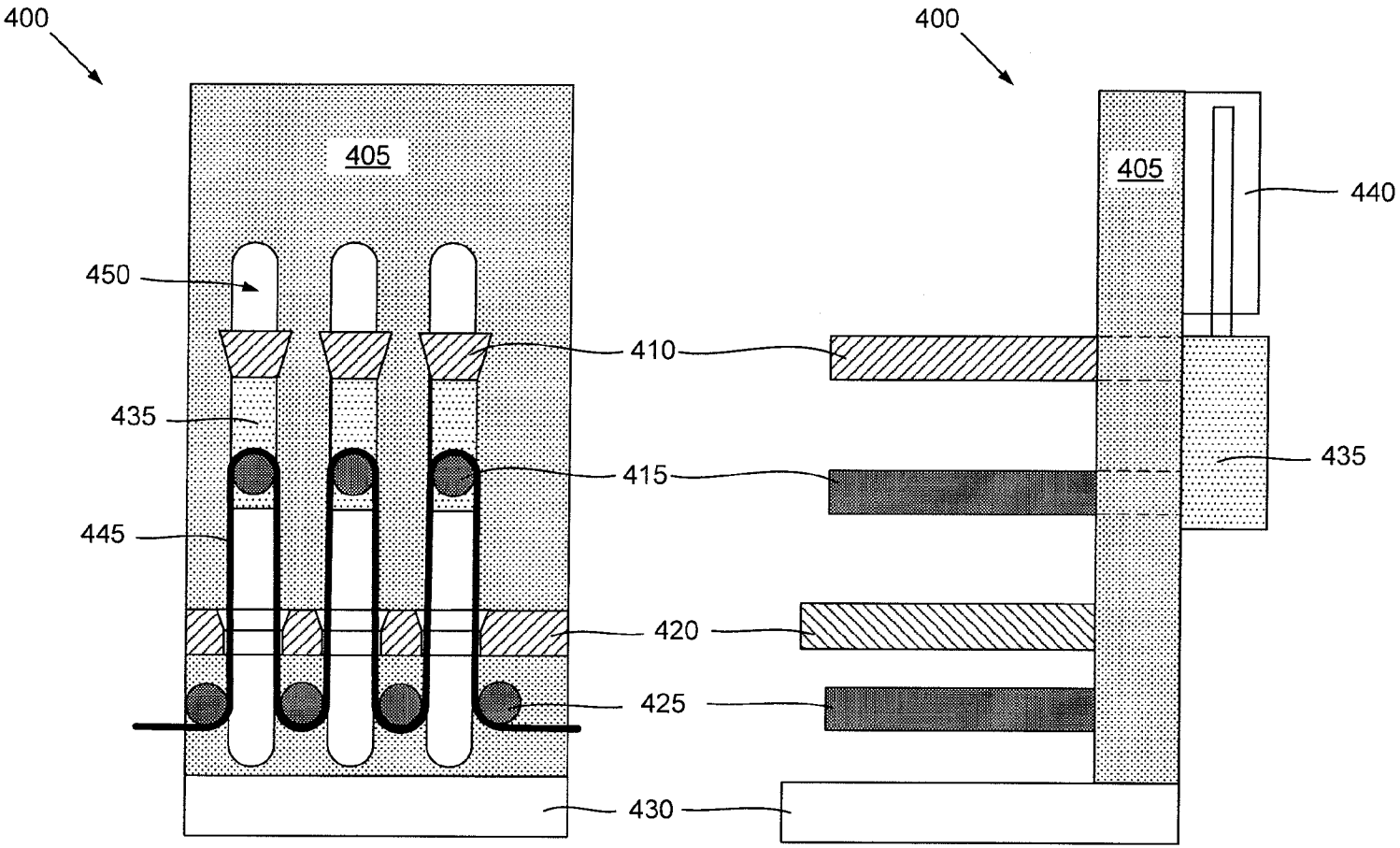
FIGS. 4A and 4B are a front view and a side view, respectively of an illustrative convertible buffer, according to one example of principles described herein.

FIGS. 4A and 4B are front and side views, respectively, of an illustrative convertible buffer (400). The buffer (400) includes a base (430) and a back plate (405). The back plate (405) includes a number of vertical parallel slots (450). A number of stationary idlers (425) are positioned in between the slots (450). Movable idlers (415) pass through the slots (450). The idlers (415, 425) may be non-rotating cylinders that the substrate slides over or may be rotating rollers that turn as the substrate passes over them. The movable idlers (415) are secured to a plate (435) that is actuated by a buffer mechanism (440). In this implementation, the movable idlers (415) and the stationary idlers (425) are both in a cantilever configuration, with only one side of each idler being supported. This illustrative convertible buffer (400) also includes a floor plate (420) and idler covers (410). A substrate (445) passes under the stationary idlers (425) and over the movable idlers (415).

During operation, the buffer mechanism (440) moves the plate (435) and the attached moveable idlers (415) and idler covers (410). As the movable idlers (410) are displaced, the substrate path length within the buffer (400) changes. For example, if the buffer (400) is interposed between an unwinder and a printing station, the buffer (400) coordinates the web speeds between the unwinder and printing station. During start up, the printer may be warmed up and ready to print but it may take a short time for the unwinder to accelerate the substrate roll, which may weigh more than 300 kilograms. The buffer could compensate for this difference in web speed by bringing the moveable idlers closer to the stationary idlers. This will dispense the substrate out of the buffer faster than substrate is entering the buffer. This allows the printer to start printing at its nominal speed while the unwinder accelerates. Once the unwinder has accelerated to match the printing speed, the buffer stops dispensing the substrate faster than it receives the substrate. The buffer can compensate for other irregularities in substrate speed and maintain a desired level of tension in the moving substrate. For example, if a print engine periodically speeds up during the printing process, a buffer on the output side of the print engine can compensate by moving the idlers apart to lengthen the substrate path within the buffer. This takes up additional substrate and maintains a substantially uniform web speed leaving the buffer.

Figure 5C:
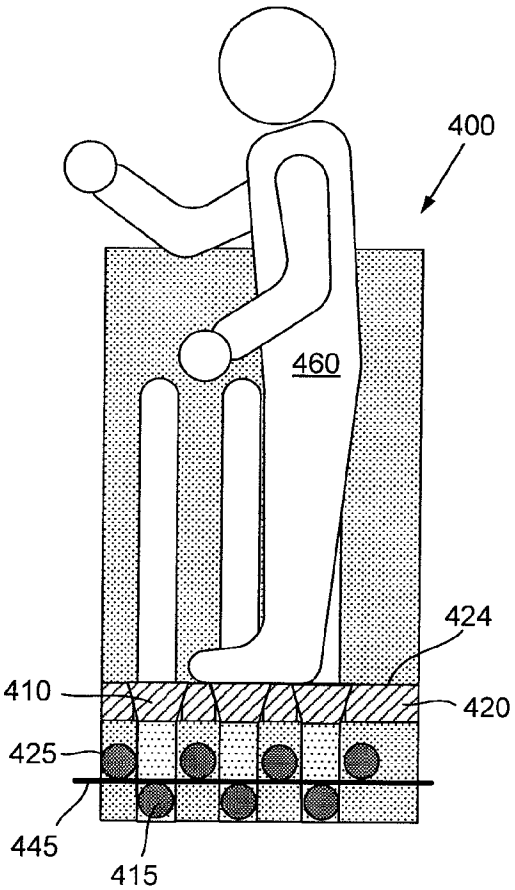
FIGS. 5A-5C are diagrams of an illustrative convertible buffer, according to one example of principles described herein.
Figure 5B:
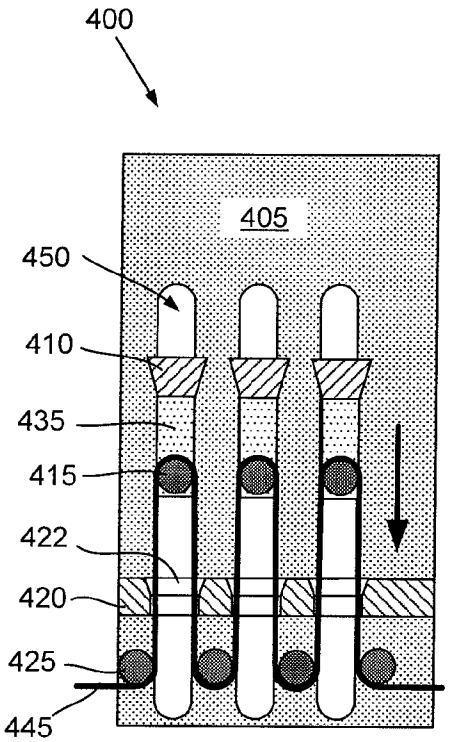
Figure 5A:
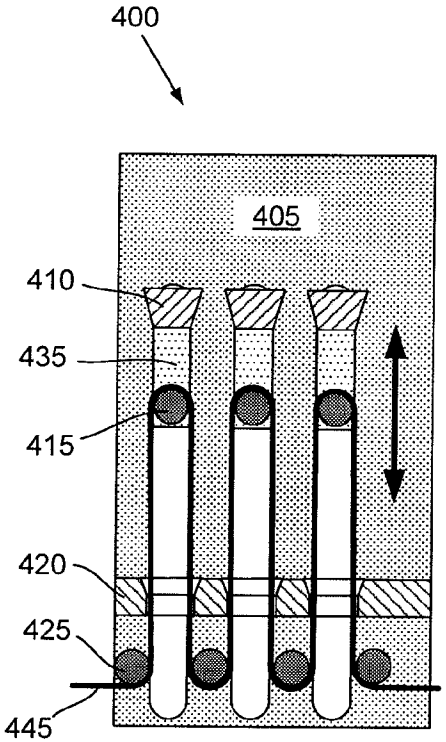

FIG. 5A is a side view of the buffer (400) during operation of the web press. As shown by the double headed arrow, the movable idlers (415), plate (435) and idler covers (410) move up and down to change the length of the substrate path within the buffer (400). The substrate (445) passes under the lower idlers (425), through the floor plate (420), and over the upper idlers (415). The buffer (400) is typically active only during the operation of the web press.

FIG. 5B shows the movable idlers (415) being lowered when the web press is not in operation. As discussed above, the movable idlers (415) are lowered using the buffer mechanism (440, FIG. 4B). The buffer mechanism (440, FIG. 4B) slides the movable idlers (415), plate (435), and idler covers (410) down the slots (450) in the back plate (405) as shown by the black arrow.

FIG. 5C is a diagram showing the non-operating configuration of the buffer (400). In this configuration, moveable idlers (415) are below the stationary idlers (425) and the idler covers (410) fit into the apertures (422, FIG. 5B) in the floor plate (410). This creates a smooth surface (424) over the entire surface of the floor plate (410). Additionally, lowering the movable idlers (415) allows for clear access to the adjoining stations. A technician (460) is standing on the floor plate (420) and idler covers (410) to access an adjoining station (not shown). As discussed above, the movable idlers (415) are located below the stationary idlers (425) and the substrate (445) follows a straight path through the lowest part of the buffer (400).

When printing on a new roll of substrate or performing other maintenance tasks, the substrate may be threaded through the buffer in either the operating configuration (shown in FIG. 5A) or in the non-operating configuration (shown in FIG. 5C). In some implementations, it may be easier to thread the paper through the buffers in the non-operating configuration.

In some implementations, at least some portions of the web press may still be in operation while the technician (460) is standing on the floor plate (420). The substrate (445) may continue to be fed through the buffer (400) beneath the technician's feet. Allowing the press to run during servicing may be important for calibration and trouble shooting. However, the buffer (400) will remain in a locked down state and will not move the moveable idlers while the technician is working on the floor plate. Consequently, as used in the specification and appended claims, the term "non-operating configuration" indicates that the buffer is not functioning to coordinate web speeds in the web press but does not necessarily indicate that other portions of the web press are not operating.

A number of safety features may be incorporated into the convertible buffer (400). There may be a light, sound or other indicator that communicates the status of the buffer (400). For example, if the buffer (400) is in the lowered configuration, a light may illuminate to indicate that it is safe to stand on the platform. Additionally, a manual lock could be used to lock the idler covers in place during maintenance operations. Other safety features could also be used. For example, an access door could remain locked or closed until the buffer (400) is lowered and locks. When the buffer (400) is lowered and locked, the access door can be opened and the technician could use the platform to service the adjoining stations. These and other safety features could be used in conjunction with a variety of buffer designs, including those described below.

The convertible buffer (400) described above is only an illustrative example. A variety of other configurations could be used. For example, the convertible buffer (400) may not include the idler covers (410). Instead, the movable idlers drop beneath the floor plate (420) and the technician (460) stands on the floor plate (420) and apertures (422). Alternatively, the idler covers (410) may be placed by a solid plate. In one implementation, the solid plate moves with the idlers and rests on the floor plate. The solid plate may also be used independently (i.e. without a floor plate) as a standing platform when the movable idlers are lowered.

Figure 6A:
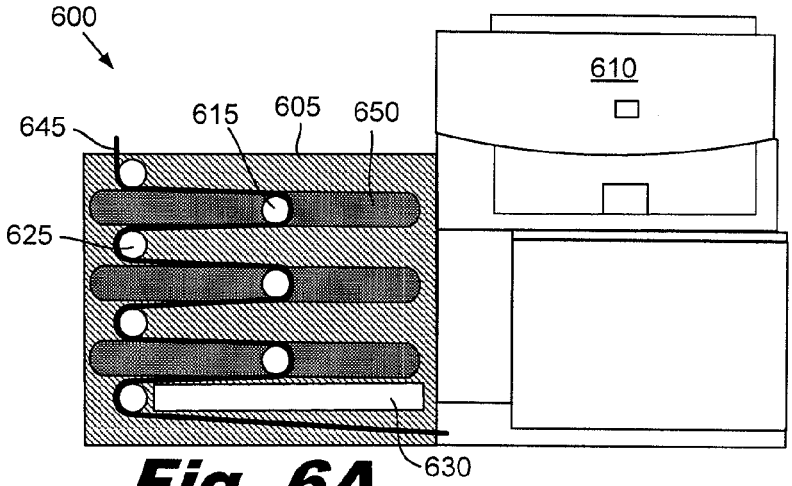
FIG. 6A-6C are diagrams of an illustrative buffer that contracts to one side to allow maintenance access, according to one example of principles described herein.
Figure 6B:
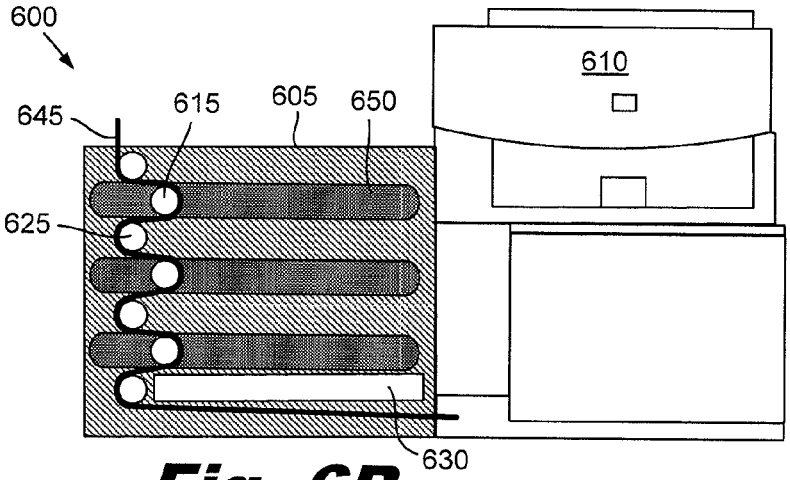
Figure 6C:
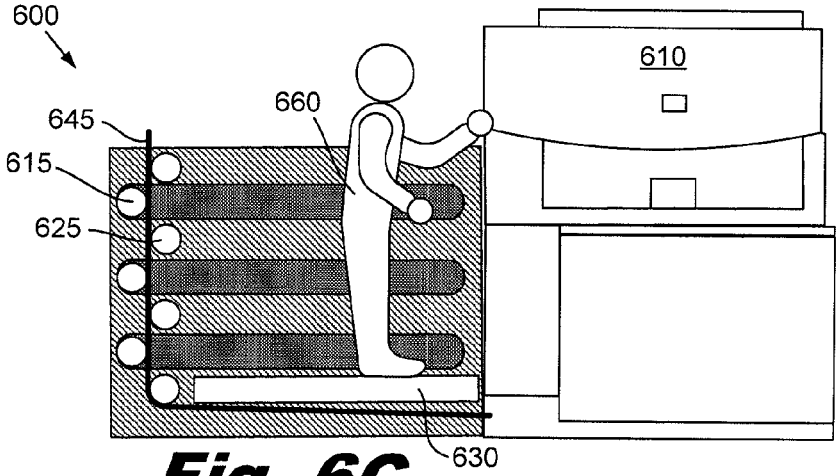

FIGS. 6A-6C are diagrams of a convertible buffer (600) where the movable idlers (615) are translated horizontally rather than vertically. FIG. 6A shows the convertible buffer (600) and an adjoining print engine (610). The movable idlers (615) move in horizontal slots (650) in the back plate (605). In this operational configuration, the substrate (645) passes to the left of the stationary idlers (625) and to the right of the movable idlers (615). As discussed above, repositioning the movable idlers (615) changes the length of the substrate path to adjust for web speed variations. The convertible buffer (600) also includes a standing platform (630).

FIG. 6B shows the movable idlers (615) translated a distance to the left to produce a shorter substrate path. FIG. 6C shows the non-operating configuration with the movable idlers (615) translated all the way to the left. In this configuration the standing platform (630) is exposed. The substrate (645) passes under the standing platform (630) and straight up through the idlers (615, 625). A technician (660) can then stand on the platform (630) and access the print engine (610). As discussed above, the web press may or may not be in operation during maintenance.

Figure 7A:
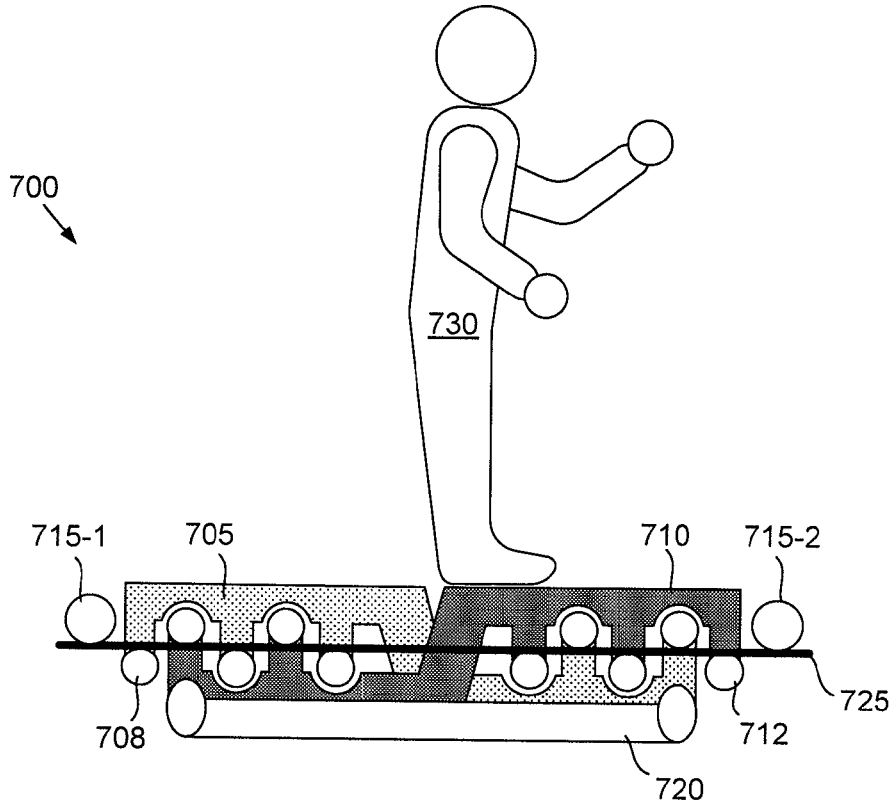
FIGS. 7A and 7B are diagrams of an illustrative convertible buffer, according to one example of principles described herein.
Figure 7B:
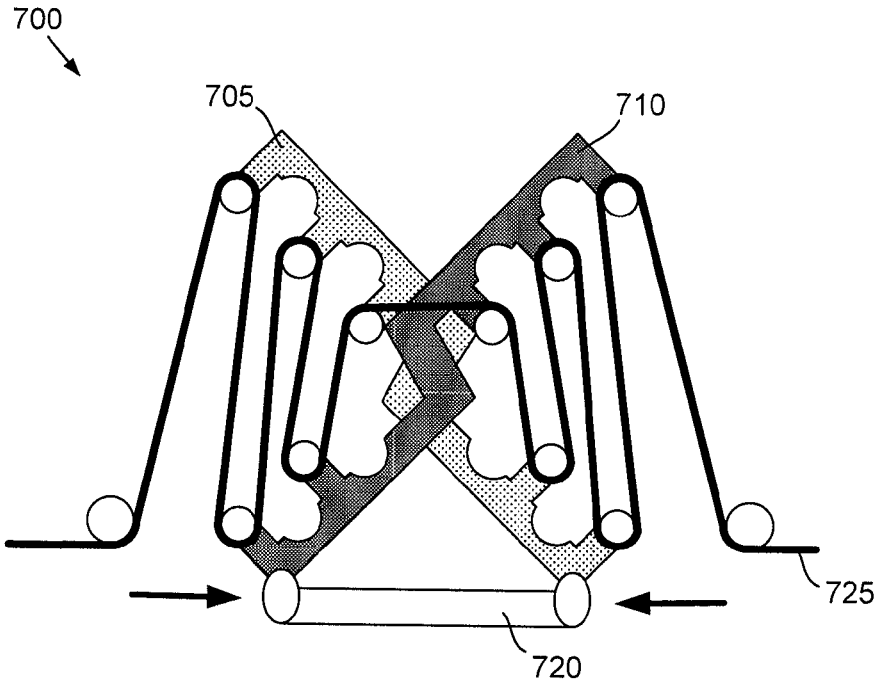

FIGS. 7A and 7B show a non-operating configuration and an operational configuration of an illustrative buffer, respectively. In FIG. 7A, a technician (730) is standing on a platform created by the upper surface of two arms (705, 710). Each of the arms (705, 710) supports a number of idlers (708, 712). The substrate (725) passes through the idlers (708, 712). The arms (705, 710) are actuated by a mechanism (720). The mechanism (720) may be hydraulic, pneumatic, mechanical or electro-mechanical. The arms are connected so that when the mechanism (720) contracts, the arms (705, 710) scissor upward. Stationary idlers (715) on either side of the buffer (700) maintain the input and output angles of the substrate (725).

FIG. 7B shows the operating configuration of the buffer (700). The arms (705, 710) are scissored upward by the contraction of the mechanism (720). The contraction of the mechanism (720) is shown by dark arrows pointing inward. The contraction of the mechanism (720) increases the distance between the idlers and thereby increases the substrate path length. This type of buffer may have a number of advantages. For example, the buffer (700) does not include a back plate. When the buffer (700) is in the reduced volume folded configuration, the technicians can easily use the buffer as a standing platform or as a walkway to reach the other side of the web press. FIGS. 7A and 7B are only illustrative examples of buffer that can serve as a walkway. A variety of other configurations could also be used.

Figure 8:
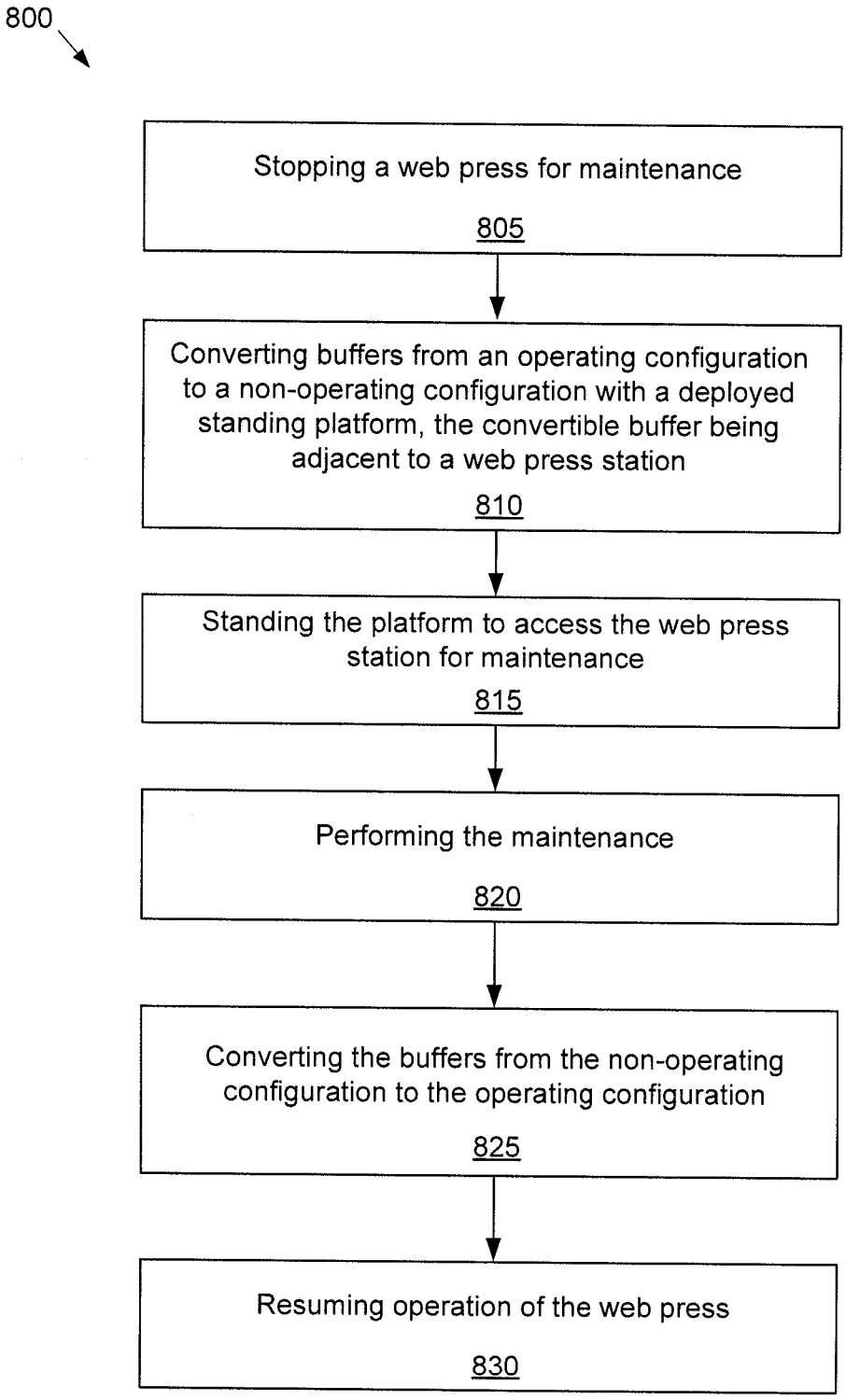
FIG. 8 is a flowchart of an illustrative method for providing maintenance access to stations in a web press, according to one example of principles described herein.

FIG. 8 is a flow chart of an illustrative method for performing web press maintenance. The method includes stopping a web press for maintenance (block 805). The buffers are converted from an operating configuration to a non-operating configuration comprising a platform, the convertible buffer being adjacent to a web press station (block 810). The technician stands on the platform to access the web press station for maintenance (block 815). The maintenance is performed (block 820). The buffers are converted from the non-operating configuration back to the operating configuration (block 825). Operation of the web press is resumed (block 830).

The method described above is only one illustrative example. Actions within the method may be omitted, added or combined. For example, the web press may be in partial operation while the buffer is in the non-operating configuration for troubleshooting, calibration, or other actions. In some implementations, only a few of the buffers are converted from an operating configuration to a non-operating configuration. For example, if only one station requires maintenance, the buffers adjacent to that station may be converted to a non-operating configuration while the other buffers may remain in the operational configuration.

In conclusion, the use of convertible buffers permits the elimination of maintenance platforms and the reduction of the foot print of web presses. The convertible buffers convert from an operating configuration to a non-operating configuration. In the operating configuration, the buffers coordinate web speeds and web tension between adjoining stations. In the non-operating configuration, the buffers provide access to the adjoining stations and serve as standing platforms for technicians or other maintenance personnel. This dual configuration increases the flexibility of the buffer while maintaining its functionality.

The convertible buffers provide a number of advantages including reducing the foot print web presses. This reduced foot print provides the press owner more flexibility in placing the web press within a facility and reduces the overall amount of space that must be allocated to the web press. This lowers the over head associated with the web press.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A web press comprising:

a web press station;

a convertible buffer near the web press station, the convertible buffer being configured to deploy a platform for accessing the web press station; and a first set of idlers and a second set of movable idlers that are spaced apart in an operating configuration and brought together in a non-operating configuration in which the first set of idlers is a stationary set of idlers on the first side of a floor plate and the moveable idlers are configured to move through the floor plate from a second side of the floor plate to the first side of the floor plate.

2. The web press of claim 1, in which the convertible buffer is configured to convert between an operating configuration in which the buffer adjusts a web path length and a non-operating configuration in which the standing platform is deployed.

3. The web press of claim 1, in which the standing platform comprises a floor plate to provide a standing surface for a technician to access the web press station.

4. The web press of claim 1, further comprising idler covers the idler covers being disposed above the movable idlers such that in the non-operating configuration the idler covers fit into apertures in the floor plate.

5. The web press of claim 1, in which the standing platform comprises a movable plate disposed over the moveable idlers and configured to move with the moveable idlers.

6. The web press of claim 1, in which the non-operating configuration comprises an unobstructed walkway from one side of the web press to an opposite side of the web press.

7. A buffer for a web press, comprising idlers and a standing platform, the buffer being convertible between an operating configuration in which spacing among the idlers is altered to change a web path length and the standing platform is not deployed and a non-operating configuration in which the standing platform is deployed for accessing an adjacent web press station, in which the idlers comprise a first set of idlers and a second set of idlers, the first set of idlers and the second set of idlers being brought together in the non-operating configuration to deploy the standing platform and the second set of idlers is linearly, horizontally translated toward the first set of idlers expose a fixed standing platform.

8. The buffer of claim 7, in which the buffer is directly adjacent to and interposed between two web press stations, the non-operating configuration being configured to provide access to sides of the two web press stations adjoining the buffer.

9. A method for performing web press maintenance comprising:

converting a buffer from an operating configuration to a non-operating configuration with a deployed standing platform, the buffer being adjacent to a web press station and comprising a first set of idlers and a second set of movable idlers that are spaced apart in an operating configuration and brought together in a non-operating configuration, the first set of stationary idlers being on a first side of a floor plate and the moveable idlers are configured to move through the floor plate from a second side of the floor plate to the first side of the floor plate; and standing on the standing platform to access the web press station for maintenance, in which the buffer alters a substrate path length to coordinate web speeds between adjacent machines during operation of a web press.

10. The web press of claim 2, in which a path of a substrate through the non-operating configuration of the convertible buffer facilitates threading of the substrate.

11. The web press of claim 10, in which the path is generally straight.

12. The buffer of claim 7, in which an idler is cantilevered.

13. The method of claim 9, in which the buffer in the non-operating condition allows other units of a web press to continue to operate.

* * * * *